United States Patent [19]

Pidsosny et al.

[11] 3,938,128

[45] Feb. 10, 1976

[54] WARNING CIRCUIT FOR INDICATING THAT AN INTERMITTENTLY OPERATED DEVICE HAS BEEN OPERATED FOR A PREDETERMINED CUMULATIVE LENGTH OF TIME

[75] Inventors: Richard A. Pidsosny, Detroit; John Zimmer, Ann Arbor, both of Mich.

[73] Assignee: Ford Motor Company, Dearborn, Mich.

[22] Filed: Nov. 12, 1974

[21] Appl. No.: 523,088

[52] U.S. Cl. ..... 340/309.1; 324/182; 340/267 R

[51] Int. Cl.[2] ..... G08B 1/00; G04F 10/00

[58] Field of Search ..... 340/248 R, 253 R, 267 R, 340/309.1, 270, 309.2, 309.3, 309.4; 324/182, 94; 317/141

[56] References Cited

UNITED STATES PATENTS 3,546,693 12/1970 Bissett et al. ..... 340/309.1

*Primary Examiner*—John W. Caldwell
*Assistant Examiner*—Daniel Myer
*Attorney, Agent, or Firm*—Robert W. Brown; Keith L. Zerschling

[57] ABSTRACT

A warning circuit particularly suited for indicating that an intermittently operated device has been operated for a predetermined cumulative length of time. The circuit utilizes a coulometer as a current integrator that accumulates the intermittent periods of time during which the device operates. At the end of the predetermined cumulative length of time, the impedance of the coulometer changes from a low level to a relative higher level. This change in impedance renders a first transistor conductive and results in a warning indication. A second transistor is latched into a state of conductivity that causes a feedback current to flow through the coulometer to maintain it in its high impedance condition. The warning indication is controlled by an amplifier circuit which, in turn, is controlled by the second transistor. Once the high impedance of the coulometer is achieved, the second transistor at all times retains its state of conductivity indicative of this condition, but the amplifier circuit is operative only when the intermittently operated device is in operation.

10 Claims, 1 Drawing Figure

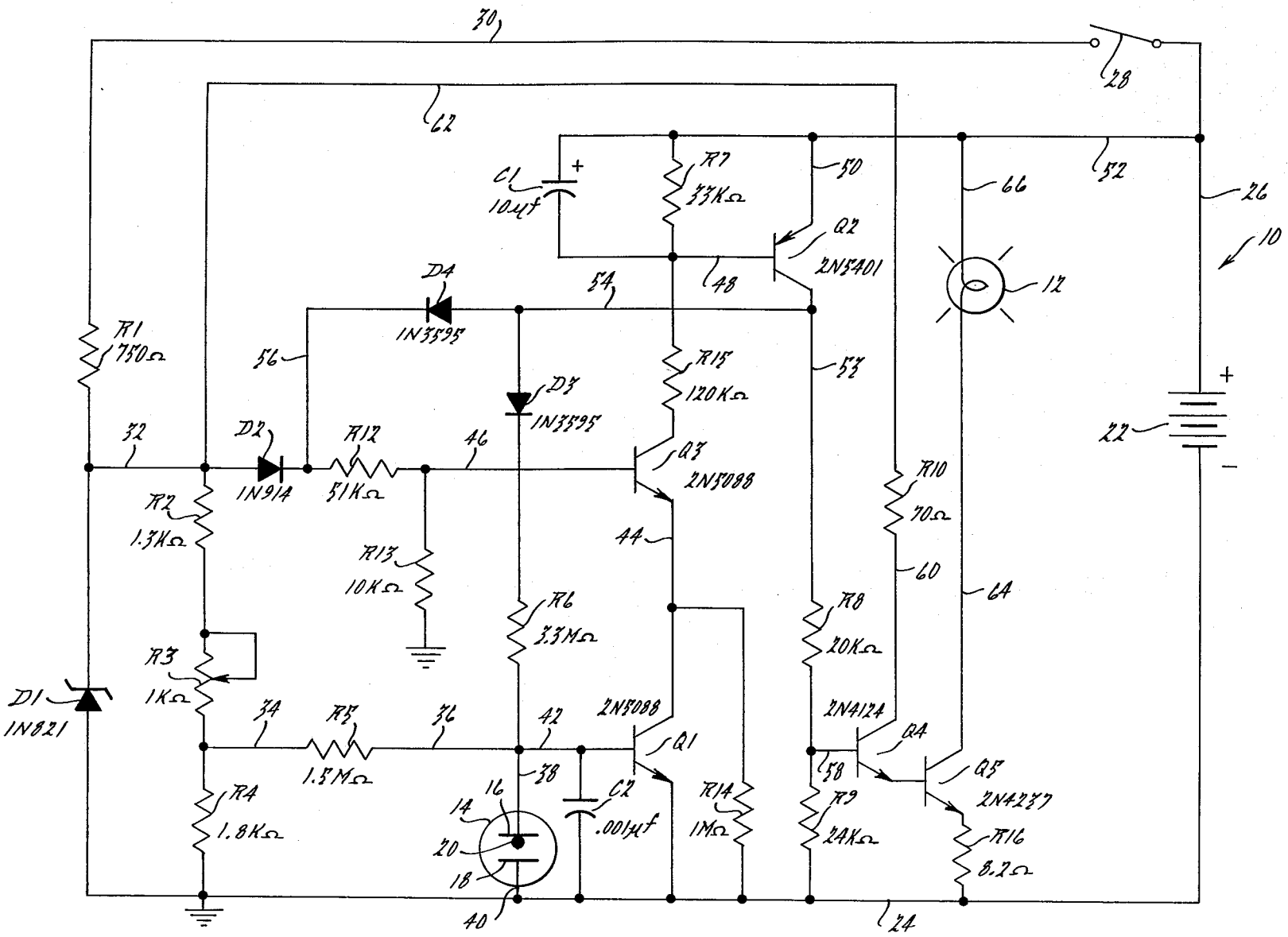
10
12
14
16
18
20
22
24
26
28
30
32
34
36
38
40
42
44
46
48
50
52
54
56
58
60
62
64
66
R1 750Ω
R2 1.3KΩ
R3 1KΩ
R4 1.8KΩ
R5 1.5MΩ
R6 3.3MΩ
R7 33KΩ
R8 20KΩ
R9 24KΩ
R10 70Ω
R12 51KΩ
R13 10KΩ
R14 1MΩ
R15 120KΩ
R16 8.2Ω
C1 10μf
C2 .001μf
D1 1N821
D2 1N914
D3 1N3595
D4 1N3595
Q1 2N5088
Q2 2N3401
Q3 2N5088
Q4 2N4124
Q5 2N4237

WARNING CIRCUIT FOR INDICATING THAT AN INTERMITTENTLY OPERATED DEVICE HAS BEEN OPERATED FOR A PREDETERMINED CUMULATIVE LENGTH OF TIME

BACKGROUND

This invention relates to a warning circuit for indicating that an intermittently operated device has been operated for a predetermined cumulative length of time. More particularly, the invention relates to a circuit which employs a coulometer to integrate a current that flows whenever a device is being operated and which undergoes a change in its impedance after that current has flowed for a predetermined cumulative length of time. The warning circuit of the invention is particularly suitable for use in providing a warning after the engine of a motor vehicle has been operated for a predetermined cumulative length of time.

A coulometer is an electrochemical storage cell that has a pair of spaced electrodes in an electrolyte material. At least one of the coulometer electrodes has an active material, usually a metal, which is transferred from that electrode to the other electrode when current flows through the coulometer in an appropriate direction. The impedance between the coulometer electrodes is at a low level when the active material is on both electrodes and is substantially higher after all of the active material has been transferred from the one electrode to the other. Of course, the rate at which the active material is transferred from the one electrode to the other is directly proportional to the magnitude of the current between the electrodes.

The coulometer may be made to carry a current whenever an intermittently operated device is in operation. If this is the case and if the amount of active material capable of being transferred from one electrode to the other and the magnitude of the current flow are known, then the change in impedance of the coulometer occurs after the intermittently operated device has been operated for a predetermined cumulative length of time. The change in coulometer impedance may be used to provide a warning indication, for example, than an intermittently operated device such as a motor vehicle requires maintenance.

Coulometer circuits used in vehicle service computers are described in U.S. Pat. Nos. 3,546,693 to Bissett, et al and 3,603,880 to Brecker, Jr., et al. U.S. Pat. No. 3,755,728 to Herzig et al discloses a coulometer circuit that measures time by the passage of a known constant current through a coulometer cell.

SUMMARY OF THE INVENTION

The coulometer warning circuit of the invention utilizes the change in impedance of a coulometer cell, which change occurs after all of its active material has been transferred from one of its electrodes to its other electrode, to effect a change in conductivity of a first transistor. The change in conductivity of the first transistor causes a second transistor, connected in a unique feedback latching circuit, to change its state of conductivity, thereby, to cause an amplifier circuit to energize a warning indicator. The change in the state of conductivity of the second transistor occurs after an intermittently operated device has been operated for a predetermined cumulative length of time, and this second transistor is maintained in this state of conductivity even when the intermittently operated device is not in operation.

A characteristic of a coulometer is that after it has reached its high impedance condition and current flow through it is discontinued, it reverts to a low impedance condition and thereafter requires several minutes of current flow through it to restore it to its high impedance condition. An important feature of the coulometer warning circuit of the invention is that once the high impedance coulometer condition has occurred and the second transistor mentioned above has changed its state of conductivity, the second transistor thereafter provides a feedback current to the coulometer which maintains it in its high impedance condition even though the intermittently operated device may not be in operation.

The second transistor also is used to control an amplifier circuit which, in turn, controls a warning device. However, the amplifier circuit is arranged such that a warning indication is not given unless the second transistor is in a particular state of conductivity and the intermittently operated device is in operation.

A potential major source of timeout error in a coulometer circuit is the leakage current of the transistor which is directly controlled by the coulometer. An important feature of the present invention is the use of a third transistor positioned in the collector circuit of the first transistor controlled by the coulometer. The presence of the third transistor reduces the leakage current of the first transistor to a negligible amount.

The invention may be better understood by reference to the detailed description which follows and to the drawing.

BRIEF DESCRIPTION OF THE DRAWING

The drawing is a schematic electrical diagram of a circuit for indicating that the engine of a motor vehicle, intermittently operated, has been operated for a predetermined cumulative length of time.

DETAILED DESCRIPTION

With reference to the drawing, wherein component values and type numbers are given by way of example and not limitation, the warning circuit shown therein is generally designated by the numeral 10. The circuit 10 provides a warning indication, by actuation of a warning lamp 12, when the intermittently operated engine of a motor vehicle has been operated for a predetermined cumulative length of time. The circuit includes a coulometer 14 having a first or working electrode 16, a second reservoir electrode 18, and an active material 20 on the first electrode which, for example, may be of a quantity sufficient to provide 1,000 microampere hours of coulometer operation before the coulometer changes from its low impedance condition to its high impedance condition. If the current flow through the coulometer is constant at 2.31 microamperes, the coulometer will reach its high impedance condition between its electrodes 16 and 18 after 433 hours of operation. If this current flows whenever the vehicle's engine is in operation, then the high impedance condition is reached after 433 hours of engine operation. If the average speed of the motor vehicle during this time interval is 31.75 miles per hour, then this time is equivalent to 13,750 miles of vehicle travel.

The circuit 10 includes a DC source of electrical energy 22 which, preferably, is a conventional 12-volt vehicle storage battery. The negative terminal of the DC source 22 is connected to a ground or common lead 24 and its positive terminal is connected by a lead 26 to one pole of a vehicle ignition switch 28 that is closed whenever the vehicle's engine is in operation. The opposite pole of the ignition switch 28 is connected by a lead 30 to a voltage regulating circuit including a resistor R1 connected in series with a zener diode D1. The anode of the zener diode D1 is connected to ground and the junction formed between its cathode and the resistor R1 is connected to a lead 32 on which a regulated voltage appears whenever the ignition switch 28 is closed.

A voltage divider is formed by a resistor R2, a variable calibration resistor R3 and a resistor R4 connected in series with one another between the regulated voltage supply lead 32 and ground lead 24. A lead 34 of a resistor R5 is connected to the junction formed between the resistors R3 and R4. The opposite lead 36 of the resistor R5 is connected by a lead 38 to the electrode 16 of the coulometer 14. The coulometer electrode 18 is connected by a lead 40 to the ground lead 24. A capacitor C2 is connected in parallel with the coulometer 14, and the electrode 16 of the coulometer is connected by leads 38 and 42 to the base of an NPN transistor Q1. The emitter of the transistor Q1 is connected to ground. A resistor R14 is connected between the collector of the transistor Q1 and the ground lead 24. Also, the collector of the transistor Q1 is connected by a lead 44 to the emitter of an NPN transistor Q3. A blocking diode D2 has its anode connected to the regulated voltage supply lead 32 and has its cathode connected to one terminal of a current limiting resistor R12. The opposite terminal of the resistor R12 is connected by a lead 46 to the base of the transistor Q3. A resistor R13 is connected between the lead 46 and ground.

The collector of the transistor Q3 is connected through a current limiting resistor R15 and by a lead 48 to the base of a PNP transistor Q2. The emitter of the transistor Q2 is connected by leads 50 and 52 to the lead 26 connected to the positive terminal of the DC source 22. A biasing resistor R7 is connected between the emitter of the transistor Q2 and its base. A capacitor C1 is connected in parallel with the resistor R7.

The collector lead 53 of the transistor Q2 is connected through current limiting and biasing resistors R8 and R9 to the ground lead 24. The collector of the transistor Q2 also is connected by a lead 54 to the respective anodes of blocking diodes D3 and D4. The cathode of the diode D3 is connected through a current limiting resistor R6 and by the lead 38 to the electrode 16 of the coulometer 14. The cathode of the blocking diode D4 is connected by a lead 56 to the junction formed between the diode D2 and the resistor R12.

NPN transistors Q4 and Q5 form an amplifier circuit for the warning lamp 12. The base of the transistor Q4 is connected by a lead 58 to the junction formed between the resistors R8 and R9. A lead 60 connects the collector of the transistor Q4, through a current limiting resistor R10 and with a lead 62, to the regulated voltage supply lead 32. The emitter of the transistor Q4 is connected to the base of the transistor Q5, and the emitter of the transistor Q5 is connected through a current limiting resistor R16 to the ground lead 24. The collector of the transistor Q5 is connected by a lead 64 to one terminal of the warning lamp 12 and the opposite terminal of the warning lamp is connected by leads 66 and 52 to the positive terminal of the DC source 22.

In the operation of the circuit 10, let it first be assumed that a preset amount of the active material 20 in the coulometer 14 is on its working electrode 16. In such case, the coulometer 14 has a low impedance condition existing between its electrodes and none of the transistors in the circuit 10 are conductive in their collector-emitter output circuits.

Resistors R2, R3, R4 and R5 together form a network that provides a constant current, which may be adjusted as desired by variation of the resistance R3. Preferably, variable resistance R3 is a wire-wound rheostat and resistors R2, R4 and R5 are of the metal-film type to minimize the resistance changes caused by environmental conditions and the passage of time. The constant current is supplied to the coulometer and flows through lead 38, between the coulometer electrodes 16 and 18 and through the lead 40 to the ground lead 24. This current flows through the coulometer whenever the vehicle's engine is running, as is determined by the closing of the switch 28 which produces the regulated supply voltage on the lead 32 and causes the current to flow through the resistor network. As the current flows through the coulometer, the active material 20 on the working electrode 16 is transferred gradually to the reservoir electrode 18. Although the vehicle's engine is operated intermittently, after a predetermined cumulative length of time all of the active material 20 is transferred from the working electrode 16 to the reservoir electrode 18. When this occurs, there is a change in the impedance of the coulometer between its electrodes, that is, its impedance becomes substantially higher than is its impedance when the active material is on both of its electrodes.

With the ignition switch 28 closed and a high impedance between the electrodes 16 and 18 of the coulometer, a bias voltage is established on the lead 42 to the base of the transistor Q1 sufficient to render the transistor Q1 fully conductive in its collector-emitter output circuit. Also, a voltage is supplied from the regulated voltage supply lead 32, through the blocking diode D2 and the resistor R12, to the base lead 46 of the transistor Q3 to render it fully conductive in its collector-emitter output circuit. As a result, current flows from the lead 52, through the resistors R7 and R15 and the output circuits of the transistors Q3 and Q1 to the ground lead 24. The voltage drop across the resistor R7 is sufficient to bias the transistor Q2 into a conductive state in its emitter-collector circuit.

The transistor Q2 is a latching transistor. Once it is rendered conductive, current flows from its emitter-collector circuit through lead 53 and resistors R8 and R9 to the ground lead 24. The transistor Q2 is maintained in this conductive state as long as the DC source 22 remains connected to the lead 52, a condition which is normal in absence of removal of the DC source 22 from the vehicle or the like.

The lead 54 connected to the collector of the latching transistor Q2 provides a current feedback path for the coulometer 14. Thus, current flows through the lead 54, through the blocking diode D3 and the resistor R6, and through the coulometer 14 to the ground lead 24. This biasing current resulting from the feedback path from the latching transistor Q2 flows even though the ignition switch 28 may be opened. This maintains the coulometer 14 in its high impedance condition. In the absence of this feedback current from the latching transistor, the coulometer 14 would revert to a low impedance condition and would require several minutes of current flow through it after closure of the ignition switch 28 in order to actuate the warning device 12. Also, it should be noted that the conduction of the transistor Q2 causes a voltage near that of the positive terminal of the DC source 22 to be applied via the lead 54 and the blocking diode D4 to the lead 56. This voltage is applied through resistor R12 to the base of the transistor Q3 to maintain it in a conductive state as long as the transistor Q2 remains latched in its conductive condition.

The amplifier circuit comprising transistors Q4 and Q5 is controlled by the latching transistor Q2 but also is controlled by the ignition switch 28. When the transistor Q2 is rendered conductive in its emitter-collector output circuit as a result of the coulometer 14 achieving its high impedance condition, a bias voltage of a positive level sufficient to render the transistor Q4 conductive appears on the transistor Q4 base lead 58 connected to the junction between the resistors R8 and R9. However, the transistor Q4 cannot conduct unless the ignition switch 28 is closed because the supply voltage for the collector of the transistor Q4 is obtained via the circuit path including ignition switch 28, lead 30, resistor R1, regulated voltage supply lead 32, lead 62 and resistor R10. Thus with the transistor Q2 conductive and the ignition switch 28 closed the transistor Q4 is conductive in its collector-emitter output circuit and supplies the base drive for the transistor Q5, which then is rendered conductive in its collector-emitter output circuit. The conductive state of the transistor Q5 energizes the warning lamp 12 to provide the vehicle operator, whenever the ignition switch 28 is closed, with an indication that a predetermined cumulative time interval of engine operation has elapsed and that vehicle maintainence is required. When the vehicle maintainence is obtained, the coulometer 14 may be replaced or, if the coulometer design permits, reversed in its position in the circuit 10 to start another predetermined cumulative time interval.

An important feature of the invention is the presence of the transistor Q3 is the circuit 10. A potential major source of coulometer timeout error is in the collector-to-base leakage current of the transistor Q1 when this transistor is nonconductive. This leakage current must flow through the coulometer 14, and it should be minimized. This leakage current of the transistor Q1 is proportional to its collector voltage. Prior to coulometer timeout and with the ignition switch 28 open, the transistor Q3 is nonconductive and all potential is removed from the collector of the transistor Q1. When the ignition switch 28 is closed prior to timeout of the coulometer 14, there is a low bias voltage level on the lead 46 connected to the base of the transistor Q3 and, as a result, the potential on the lead 44 connected to the collector of the transistor Q1 is maintained at a very low level. Moreover, the only source of collector-base leakage current of the transistor Q1 is that derived from the leakage current of the transistor Q3, and this current is shunted by the resistor R14 connected between the collector of the transistor Q1 and the ground lead 24. Experimental results have shown that the collector-base leakage current of the transistor Q1 is in the picoampere range.

The function of the capacitors C1 and C2 is to maintain the transistor Q2, once latched in a conductive state, in such state during the presence of negative transients on the DC source lead 26 or electromagnetic interference.

Based upon the foregoing description of the invention what is claimed is:

1. A warning circuit for indicating that an intermittently operated device has been operated for a predetermined cumulative length of time, said warning circuit comprising:

a coulometer having first and second electrodes and an active material capable of being transferred from said first electrode to said second electrode, said coulometer having an impedance after all of said active material is transferred to said second electrode that is substantially higher than its impedance when said active material is on both of said electrodes;

means for causing the transfer of said active material from said first electrode to said second electrode of said coulometer when said intermittently operated device is in operation;

means for providing a warning;

a first transistor coupled to said coulometer, said first transistor changing in its state of conductivity when said higher-impedance condition of said coulometer occurs;

a second transistor coupled to said first transistor, said second transistor being placed in and maintained in a state of conductivity as a result of the initial occurrence of said change in state of conductivity of said first transistor, said second transistor when in said maintained state of conductivity supplying current to said coulometer to maintain it in its higher impedance condition;

circuit means for controlling said warning means, said circuit means permitting said warning means to provide a warning indication only when said device is in operation and said second transistor is in said maintained state of conductivity, whereby, said warning indication may be used to indicate the elapse of said predetermined cumulative length of time.

2. A warning circuit according to claim 1 which further includes a third transistor, said third transistor being coupled to the collector of said first transistor, said third transistor limiting the collector-base leakage current of said first transistor when said first transistor is nonconductive.

3. A warning circuit according to claim 1 which further includes means for determining when said intermittently operated device is in operation and wherein said circuit means for controlling said warning means comprises a transistor amplifier circuit, said transistor amplifier circuit being controlled by said second transistor and by said means for determining when said intermittently operated device is in operation.

4. A warning circuit according to claim 3 which further comprises a third transistor coupled to the collector of said first transistor, said third transistor limiting the collector-base leakage current of said first transistor when said first transistor is nonconductive.

5. A warning circuit for indicating that an intermittently operated device has been operated for a predetermined cumulative length of time, said warning circuit comprising:

a DC source of electrical energy;

a coulometer having first and second electrodes and an active material capable of being transferred from said first electrode to said second electrode, said coulometer having an impedance after all of said active material is transferred to said second electrode that is substantially higher than its impedance when said active material is on both of said electrodes;

means for coupling said DC source to said coulometer when said intermittently operated device is in operation, said coulometer when coupled to said DC source through said coupling means having a current flowing through it which tends to transfer said active material from said first electrode to said second electrode;

latching circuit means, actuated when said coulometer reaches its higher impedance condition, for causing when actuated a current to flow through said coulometer that tends to maintain said coulometer in said higher impedance condition when said coulometer is not coupled to said DC source by said coupling means; and warning means for indicating the elapse of said predetermined cumulative length of time as signified by the occurrence of said higher impedance condition of said coulometer, said warning means being controlled by said latching circuit means and by said coupling means.

6. A warning circuit according to claim 5 which further comprises a first transistor, coupled to said coulometer said first transistor being rendered conductive when said coulometer attains its higher impedance condition, and means for limiting the collector-base leakage current of said first transistor when said first transistor is nonconductive.

7. A warning circuit according to claim 6 wherein said means for limiting the collector-base leakage current of said first transistor comprises a second transistor having an output circuit coupled to the collector of said first transistor.

8. A warning circuit according to claim 7, said latching circuit comprising a third transistor, the output circuit of said third transistor being-coupled to the control electrode of said second transistor, said second transistor being maintained conductive in its output circuit when said latching circuit is actuated.

9. A warning circuit according to claim 8, said warning circuit further comprising a fourth transistor having a control electrode coupled to said latching circuit and having an output circuit coupled to said DC source only when said intermittently operated device is in operation, and a fifth transistor having a control electrode coupled to the output circuit of said fourth transistor, said fifth transistor having an output circuit coupled to said warning means, said warning means providing a warning indication when said latching circuit is actuated and said intermittently operated device is in operation.

10. A warning circuit for indicating that an intermittently operated device has been operated for a predetermined cumulative length of time, said warning circuit comprising:

a DC source of electrical energy;

a coulometer having first and second electrodes and an active material capable of being transferred from said first electrode to said second electrode, said coulometer having an impedance after all of said active material is transferred to said second electrode that is substantially higher than its impedance when said active material is on both of said electrodes;

a switch, said switch being connected at one of its poles to said DC source and said switch being closed when said intermittently operated device is in operation;

a resistance network coupled to said switch and to said coulometer, when said switch is closed said resistance network supplying a current to said coulometer, said current tending to transfer said active material from said first electrode to said second electrode;

a first transistor having a control electrode coupled to said first electrode of said coulometer and having an output circuit;

a second transistor having a control electrode and an output circuit, said second transistor being rendered conductive when said first transistor is rendered conductive and said second transistor when conductive supplying a current to said coulometer;

a third transistor having a control electrode and an output circuit, the output circuit of said third transistor being coupled to the output circuit of said first transistor and to the control electrode of said second transistor, the control electrode of said third transistor being coupled to the output circuit of said second transistor, said first transistor output circuit being conductive when said coulometer is in its higher impedance condition and said output circuits of said second and third transistors being conductive when the output circuit of said first transistor is conductive;

a warning device; and an amplifier circuit, said amplifier circuit being coupled to said warning device and to said output circuit of said second transistor, said warning device being actuated when said second transistor output circuit is conductive and said switch is closed, the actuation of said warning device being indicative of the elapse of said predetermined cumulative length of time.

* * * * *